US009295325B2

(12) United States Patent
Luebke et al.

(10) Patent No.: US 9,295,325 B2
(45) Date of Patent: Mar. 29, 2016

(54) ENERGY ABSORBENT TABLE

(71) Applicant: Kustom Seating Unlimited, Inc., Bellwood, IL (US)

(72) Inventors: William John Luebke, Aurora, IL (US); Yates Allen Sikes, Des Plaines, IL (US); Jon Lane, Des Plaines, IL (US)

(73) Assignee: Kustom Seating Unlimited, Inc., Bellwood, IL (US)

( * ) Notice: Subject to any disclaimer, the term of this patent is extended or adjusted under 35 U.S.C. 154(b) by 0 days.

(21) Appl. No.: 14/623,064

(22) Filed: Feb. 16, 2015

(65) Prior Publication Data

US 2015/0366337 A1 Dec. 24, 2015

Related U.S. Application Data

(60) Provisional application No. 62/016,405, filed on Jun. 24, 2014.

(51) Int. Cl.

| | |
|---|---|
| ***A47B 23/04*** | (2006.01) |
| ***A47B 13/08*** | (2006.01) |
| ***A47B 13/02*** | (2006.01) |
| ***F16F 7/12*** | (2006.01) |

(52) U.S. Cl.

CPC ..... *A47B 13/081* (2013.01); *A47B 13/02* (2013.01); *A47B 13/088* (2013.01); *A47B 23/04* (2013.01); *F16F 7/12* (2013.01)

(58) Field of Classification Search

CPC .... A47B 13/081; A47B 13/02; A47B 13/088; A47B 23/04; A47B 31/06; A47B 5/04; A47B 5/06; F16F 7/12; B60N 3/001

USPC ..... 108/179

See application file for complete search history.

(56) References Cited

U.S. PATENT DOCUMENTS

| | | | | | |
|---|---|---|---|---|---|
| 2,587,098 | A * | 2/1952 | Binz | A47B 13/081 | 108/140 |
| 3,224,391 | A * | 12/1965 | Cooper | A47B 11/00 | 108/140 |
| 3,391,960 | A * | 7/1968 | Megargle | A47B 23/04 | 108/44 |
| 4,130,070 | A * | 12/1978 | Herrin | B60P 3/36 | 108/143 |
| 4,170,380 | A * | 10/1979 | Raitport | B60N 2/4221 | 267/153 |
| 5,771,815 | A * | 6/1998 | Leftwich | B60P 3/36 | 108/115 |
| 5,823,616 | A * | 10/1998 | Scott | A47B 83/02 | 108/48 |
| 6,055,911 | A * | 5/2000 | Krenzer | B60N 3/004 | 108/44 |

(Continued)

FOREIGN PATENT DOCUMENTS

DE 3915173 A1 * 11/1989 ..... B60N 2/2839

*Primary Examiner* — Hanh V Tran

(74) *Attorney, Agent, or Firm* — McCracken & Gillen LLC

(57) ABSTRACT

A workstation table having a first panel, a second panel, a support member, and a first deforming mechanism is disclosed. The first deforming mechanism is coupled to the first panel and the support member, and includes a first deformable member. The first panel has a first top surface and a first outer edge, and the second panel has a second top surface and a second outer edge. When a force is applied to a first outer edge, the first deforming mechanism causes deformation of the first permanently deformable member, and causes the first panel to move from a first configuration to a second configuration. In the first configuration, the first top surface and the second top surface occupy substantially parallel planes, and in the second configuration the first top surface and the second top surface do not occupy substantially parallel planes.

35 Claims, 16 Drawing Sheets

(56) References Cited

U.S. PATENT DOCUMENTS 8,297,204 B1 * 10/2012 Giannoccora ..... A47B 13/081 108/143
8,915,198 B2 * 12/2014 Massimini ..... A47B 13/088 108/64
2009/0293774 A1 * 12/2009 Cheung ..... A47B 5/06 108/44
2010/0201163 A1 * 8/2010 Dunkel ..... B60N 2/0232 297/124
2011/0036274 A1 * 2/2011 Poost ..... A47B 3/087 108/42
2013/0092059 A1 * 4/2013 Brutter ..... E04H 9/02 108/11
2014/0026788 A1 * 1/2014 Kallio, III ..... A47B 13/081 108/6

* cited by examiner

ENERGY ABSORBENT TABLE

CROSS REFERENCE TO RELATED APPLICATION

The present application claims benefit of Luebke, et al., U.S. Provisional Patent Application Ser. No. 62/016,405, filed on Jun. 24, 2014, and entitled "Collapsible Workstation Table." The entire contents of this application is incorporated herein by reference.

FIELD OF THE DISCLOSURE

The present subject matter relates to a workstation table, and more particularly, to an energy absorbent table.

BACKGROUND OF THE DISCLOSURE

A transit car may include a workstation table disposed between facing seats. If the transit car abruptly decelerates, for example, because of an accident, a passenger in one of the seats facing the direction of the movement of the transit car could suddenly be thrust into the workstation table. The impact of the passenger with a tabletop of the workstation table may seriously injure the passenger.

SUMMARY OF THE DISCLOSURE

According to one aspect, an energy absorbing table that deforms in response to application of energy thereto includes a support member, a first panel, and a first arm. The first arm is coupled to the first support member by a first deformable member and to the first panel by a second deformable member. A first cam and a first stop are associated with the first deformable member. Application of a force to the first panel causes the first arm to move in synchrony with the first deformable member and the second deformable member, and the first deformable member rotates with the first cam until the first cam engages the first stop. Application of force to the first panel after engagement of the first cam and the first stop causes the first panel to move in synchrony with deformation of the first deformable member.

According to another aspect, an energy absorbing table that deforms in response to application of energy thereto includes a support member, a first panel, and an arm coupled to the support member by a first deformable member. The table also includes a first cam and a first stop associated with the first deformable member. When a force is applied to the first panel, the arm moves in synchrony with both the first deformable member and the first cam until the first cam engages the first stop, and in synchrony with deformation of the first deformable member after the first cam engages the first stop. The amount of force necessary to cause the arm to move after the first cam engages the first stop is determined by a characteristic of the first deformable member.

According to a further aspect, a workstation table includes a first panel, a second panel, a support member, and a first deforming mechanism. The first deforming mechanism is coupled to the first panel and the support member, and comprises a first permanently deformable member. The first panel has a first top surface and a first outer edge, and the second panel has a second top surface and a second outer edge. When a force is applied to the first outer edge, the first deforming mechanism causes deformation of the first permanently deformable member, and causes the first panel to move from a first configuration to a second configuration. In the first configuration, the first top surface and the second top surface occupy substantially parallel planes, and in the second configuration the first top surface and the second top surface do not occupy substantially parallel planes.

DETAILED DESCRIPTION

Figure 1:
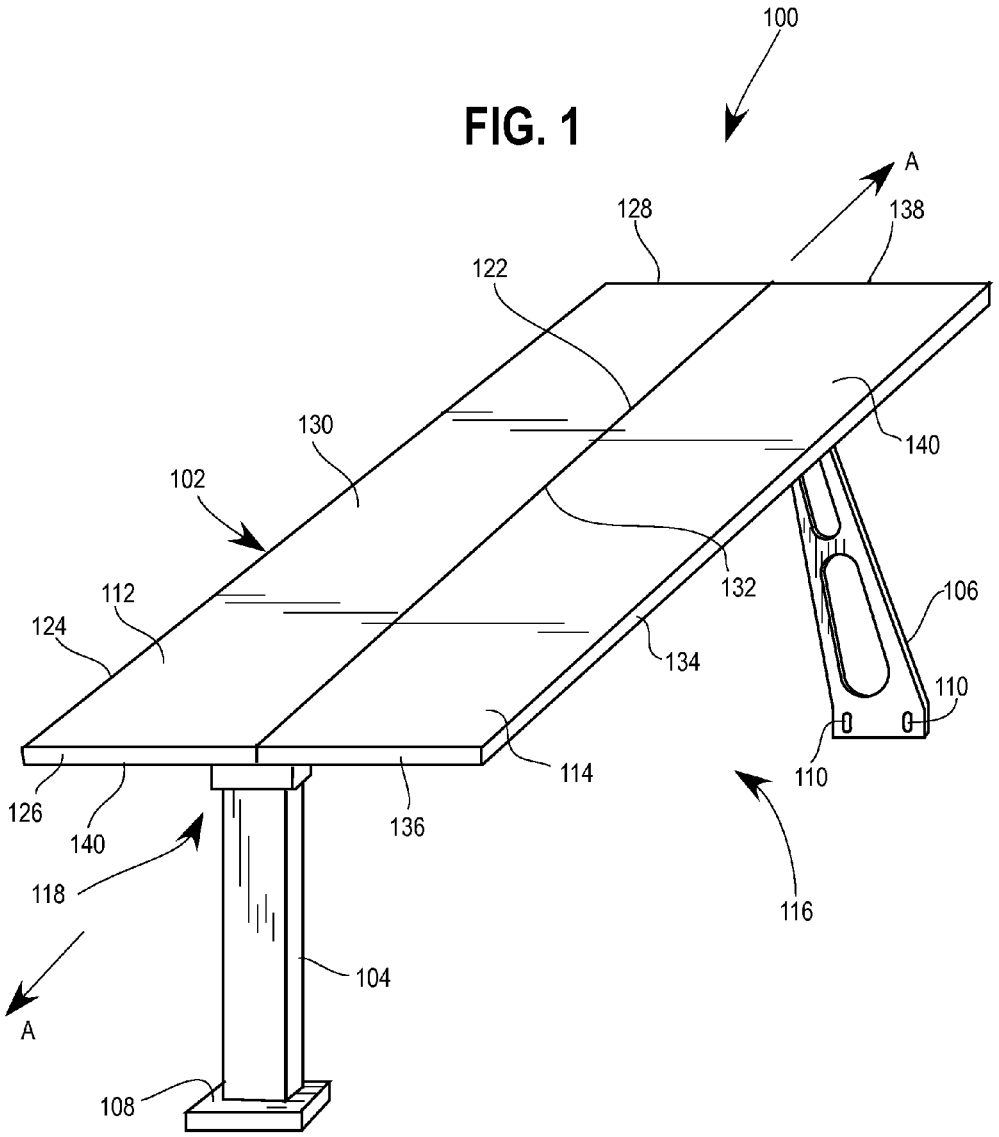
FIG. 1 is an isometric view of a workstation table.
Figure 2:
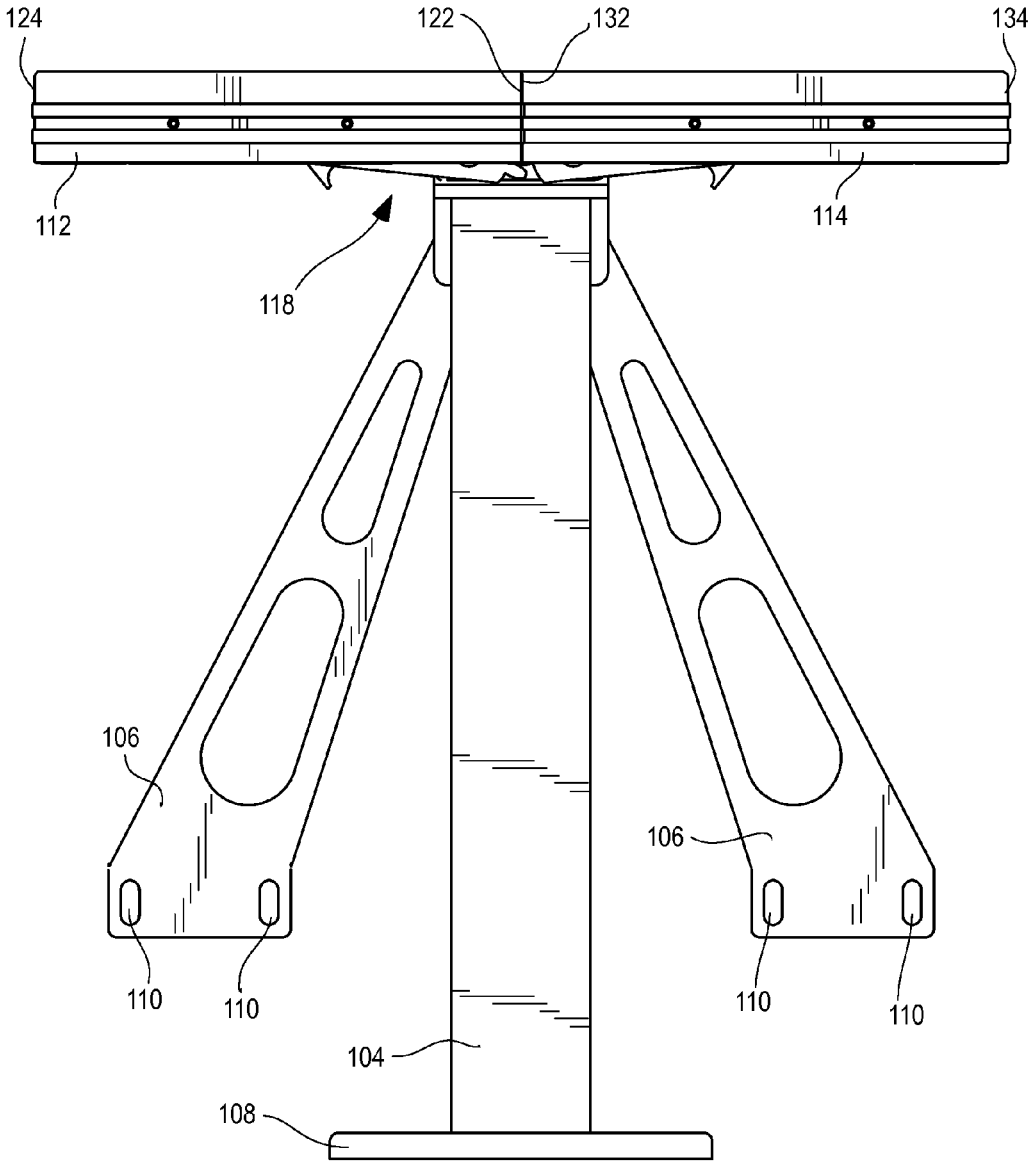
FIG. 2 is a front view of the workstation table of FIG. 1.
Figure 3:
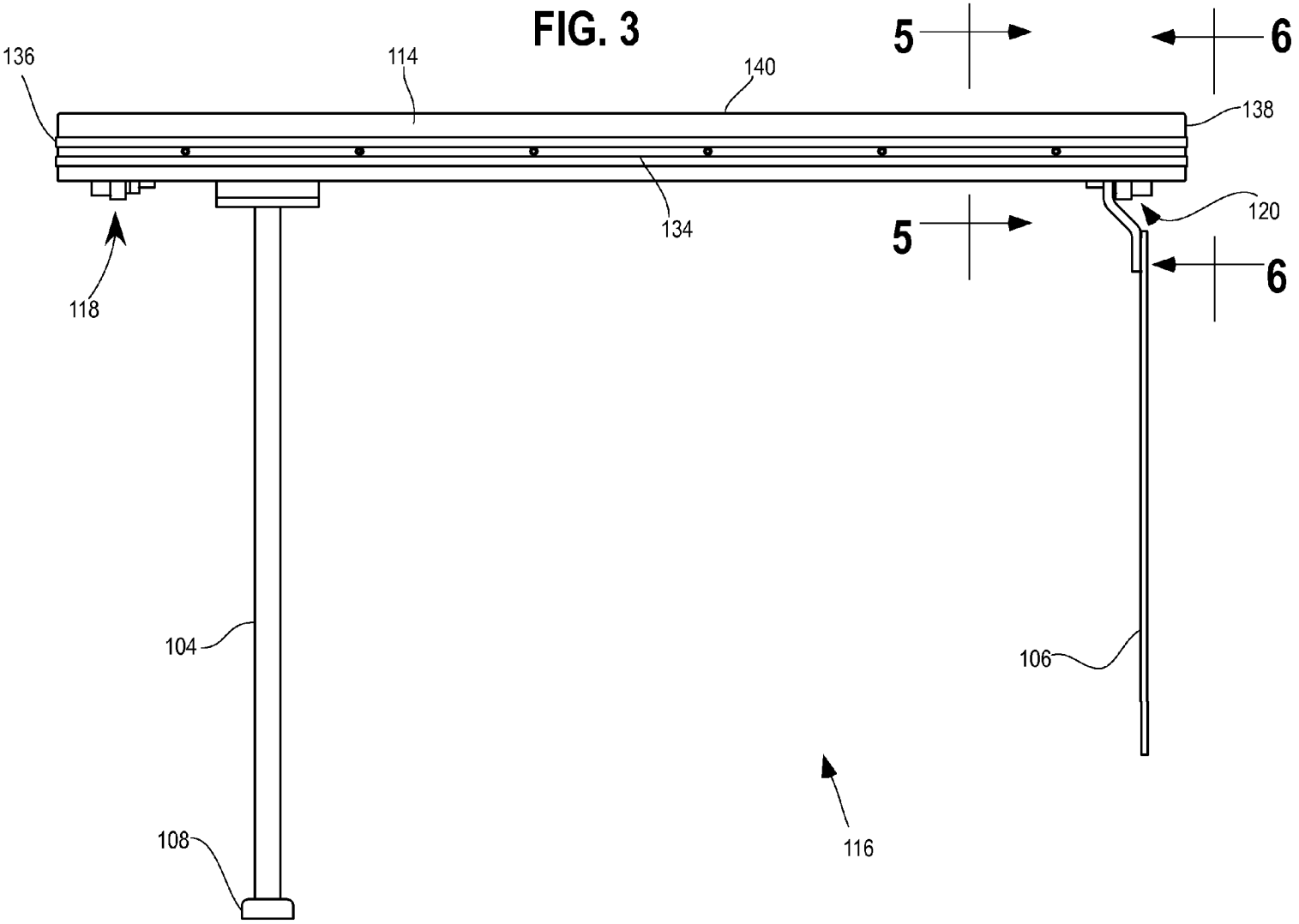
FIG. 3 is side view of the workstation table of FIG. 1.

Referring to FIGS. 1-3, a workstation table 100 comprises a tabletop 102 disposed on a front support 104 and a rear support 106. The workstation table 100 may be disposed in a vehicle, for example, a transit car, a rail car, a tram, a bus, an airplane, and the like. If the transit car has an aisle, the front support 104 may be proximate the aisle of the vehicles. In some embodiments, a bottom portion 108 of the front support 104 may be secured to a floor (not shown) of the transit car. In addition, the workstation table 100 may be disposed in the transit car so that the rear support 106 may be secured to a sidewall (not shown) of the transit car. In some embodiments, securing bolts may be passed through openings 110 to affix the workstation table 100 to the sidewall. Similarly, in some embodiments bolts or other securing devices may be passed through openings (not shown) in the bottom portion 108 to secure the workstation table 100 to the floor.

The tabletop 102 may comprise a first side portion or panel 112 and a second side portion or panel 114. The front support 104 may be disposed between the first panel 112 and the second panel 114. In some embodiments, the front support 104 may be aligned with a centerline A-A between the first panel 112 and the second panel 114. In some cases, the tabletop 102, the front support 104, and the rear support 106 may be disposed to create a space 116 under the tabletop 102. Such space 116 provides legroom for individuals seated at the workstation table 100. In some embodiments, the first panel 112 and the second panel 114 are separate members of the tabletop 102. In other embodiments, the first panel 112 and the second panel 114 are an integral unit, and are, for example, portions of a contiguous sheet of material that comprises the tabletop 102.

Each side panel 112 and 114 may be coupled to a first deforming mechanism 118 and a second deforming mechanism 120, which are described below. The first panel 112 may include an inside edge 122, an outside edge 124, a front edge 126, a rear edge 128, and a top surface 130. The inside edge 122 and the outside edge 124 may be substantially parallel and opposite one another, and the front edge 126 and the rear edge 128 may be substantially parallel and opposite one another.

Similarly, the side panel 114 may include an inside edge 132, an outside edge 134, a front edge 136, a rear edge 138, and a top surface 140. The inside edge 132 and the outside edge 134 may be substantially parallel and opposite one another, and the front edge 136 and the rear edge 138 may be substantially parallel and opposite one another.

In some embodiments, the inside edge 122 of the first panel 112 may abut or be proximate the inside edge 132 of the second side panel 114 along the centerline A-A. Further, in some embodiments, when the tabletop 102 is in an undeformed configuration (as shown in FIG. 1), the plane of the top surface 130 of the first panel 112 may be substantially parallel to the plane of the top surface 140 of the second panel 114. In some embodiments, when the table is in the undeformed configuration, one or both of the planes of the top surface 130 and the top surface 140 may be substantially parallel to the plane of the floor to which the bottom portion 108 of the front support 104 is secured. In some embodiments, the top surface 130 and the top surface 140 may be substantially coplanar. Further, in some embodiments, the front edges 126 and 136 may be substantially collinear and/or the rear edges 128 and 138 may be substantially collinear.

Figure 4A:
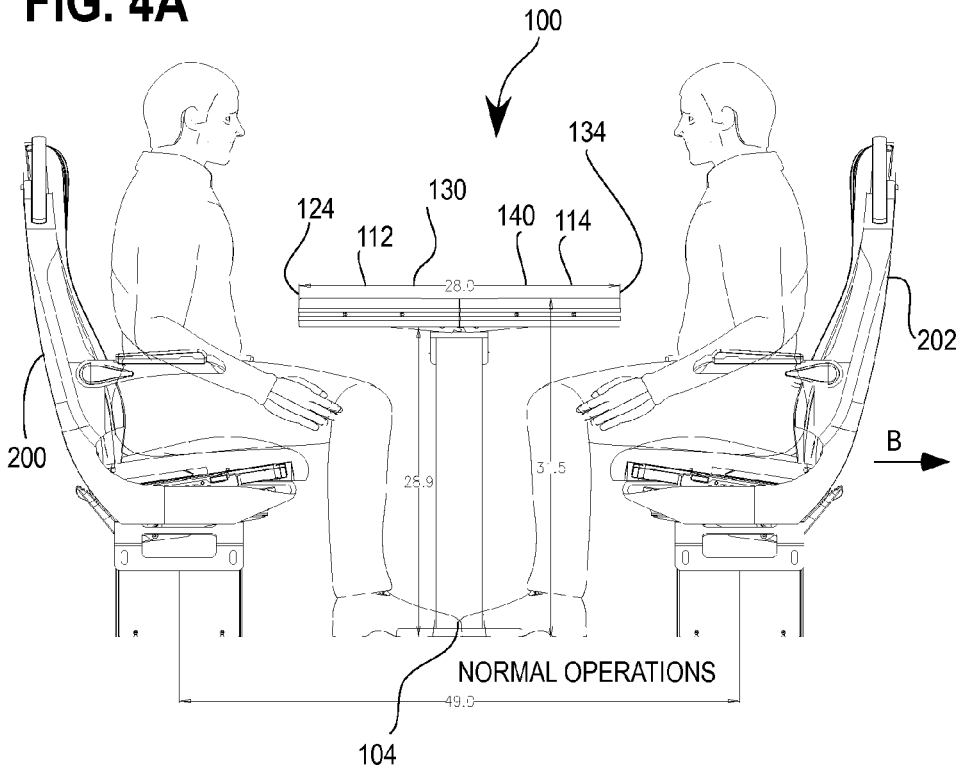
FIGS. 4A-4E are schematic views that illustrate how a tabletop of the workstation of FIG. 1 may deform.

Referring to FIG. 4A, in one embodiment, the workstation table 100 may be disposed between facing seats 200 and 202. The seats 200 and 202 may be individual seats or bench seats. A plurality of seats 200 may be disposed on one side of the workstation table 100, and a plurality of seats 202 may be disposed on the other side of the workstation table 100. Each of the seats 200 and 202 may include any type of seating apparatus that allows one or more individuals to sit thereon.

Because the front support 104 may be disposed along the centerline A-A of the workstation table 100, sufficient clearance may be provided between the front support 104 and the seats 200 and 202 for passengers to enter and exit the space between the workstation table 100 and such seats 200 and 202.

Figure 4B:
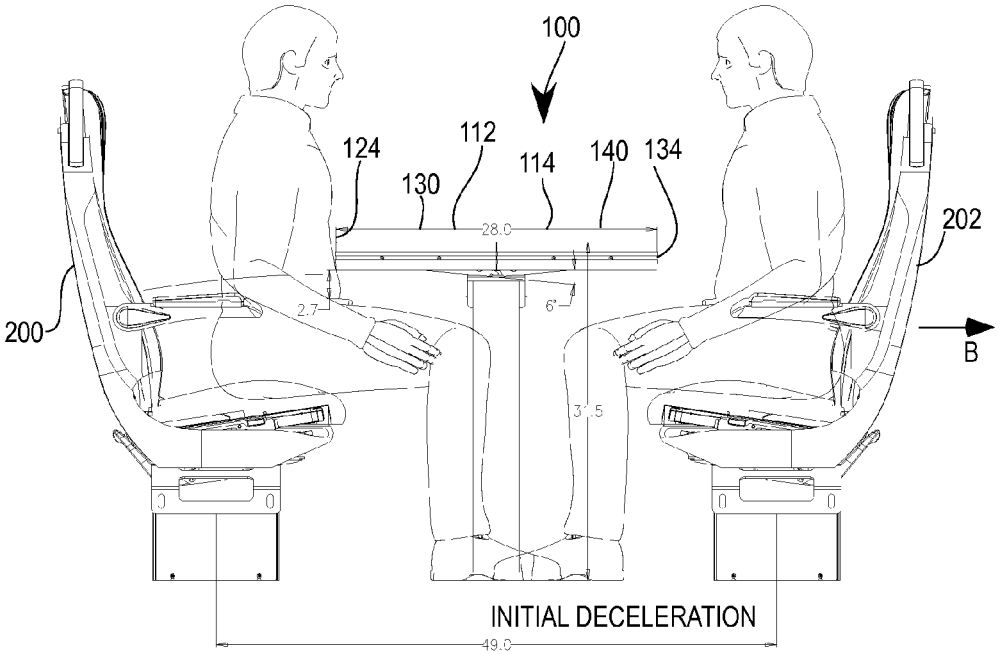
Figure 4C:
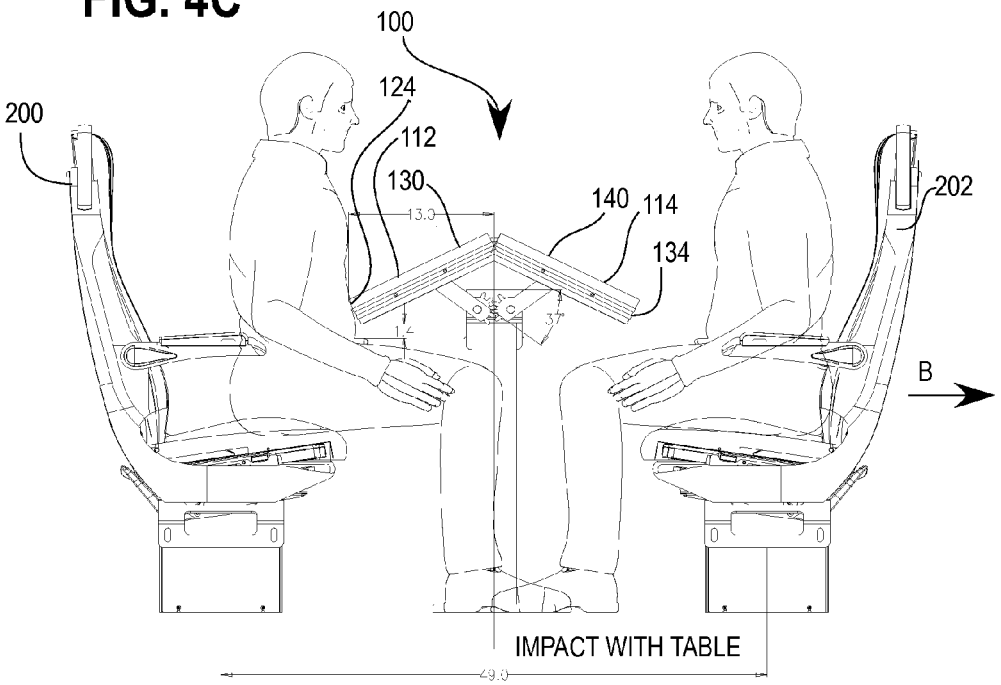
Figure 4D:
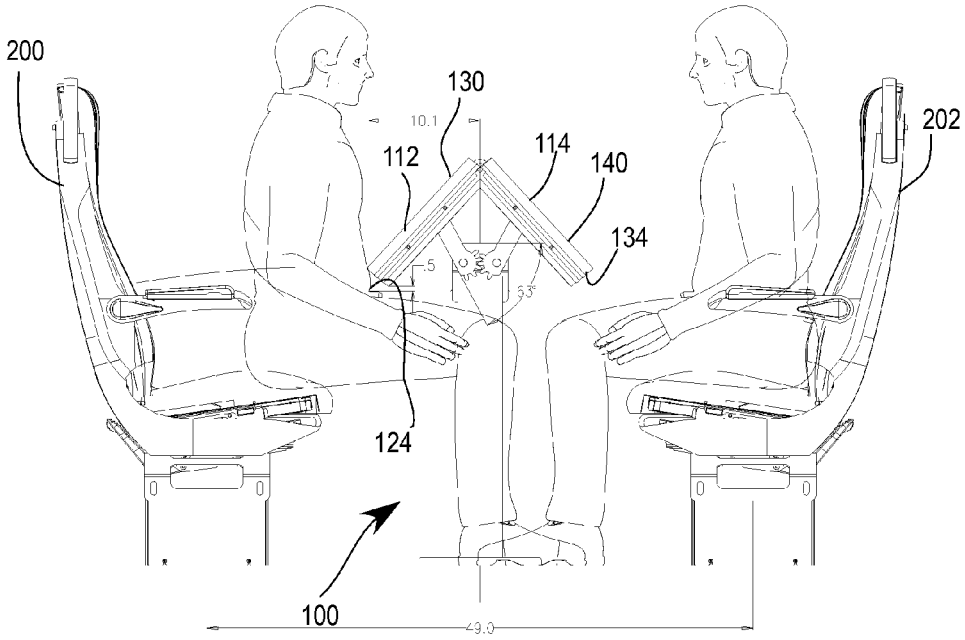
Figure 4E:
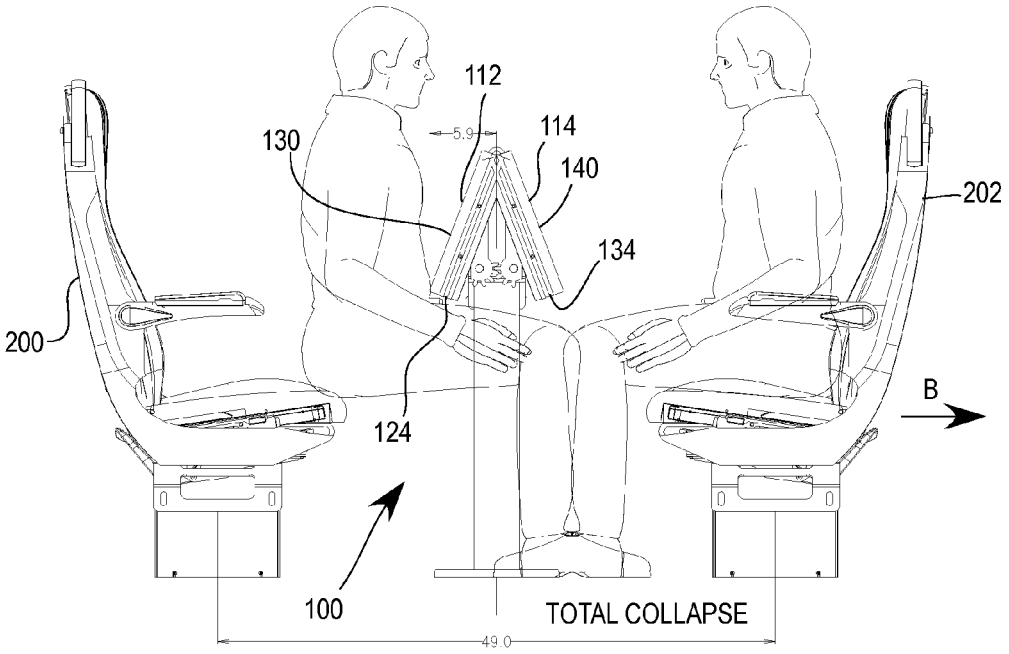

Referring to FIGS. 4B-4E, if the workstation table 100 is disposed in a transit car that is moving in a direction B, and the transit car experiences sudden deceleration, the momentum of the passenger seated in the seat 200 may cause the passenger to continue to move in the direction B at a speed greater than that of the transit car and workstation table 100. If the deceleration is significant, the passenger's body may not decelerate sufficiently in time to avoid contact with the outside edge 124 of the first panel 112 of the workstation table 100, as shown in FIG. 4B. If the passenger's body continues to move in the direction B faster than the transit car, even after such contact, the force of the passenger's body against the outside edge 124, and hence, the first panel 112, causes the tabletop 100 to deform (or collapse or buckle). In particular, as is described below, the deforming mechanisms 118 and 120 cause the first panel 112 and the second panel 114 to move from a configuration in which the top surfaces 130 and 140 thereof, respectively, occupy parallel planes or are coplanar, and into a configuration in which such top surface 130 and 140 no longer occupy parallel planes and are not coplanar. In some embodiments, when the tabletop 100 is in a deformed configuration, the angle between the plane occupied by the top surface 130 of the first panel 112 and the plane occupied by the top surface 140 of the second panel 114 is acute. In some embodiments, the acute internal angle between such planes may be approximately 39 degrees. In some embodiments, such acute internal angle may be between approximately 35 and 43 degrees.

When the passenger impacts an outside edge 124 or 134 of the tabletop 102, energy is transferred from the passenger to cause first and second deforming mechanisms 118 and 120 to operate, and move the first panel 112 and the second panel 114 to deform the tabletop 102. Such transfer of energy may also cause the passenger to decelerate and reduce the possibility of further impact between the passenger and the table, and thus reduce the risk of injury to the passenger from such impact. Even when the tabletop 102 deforms (as shown in FIGS. 4B-4E), the front support 104 and/or the rear support 106 may continue to secure the workstation table 100 to the sidewall and/or the floor, respectively, of the transit car. In some embodiments, the front support 104 and/or the rear support 106 may also deform as the tabletop 102 deforms, yet continue to secure the workstation table 100 to the sidewall and/or the floor respectively.

Although FIGS. 4B-4E illustrate deformation of the tabletop 102 when a transit car moving in the direction B decelerates, one of skill in the art would appreciate that if a transit car moving in a direction opposite to the direction B were to suddenly decelerate, a passenger in the seat 202 would be urged into the workstation table 100, and cause the tabletop 102 to deform as described above.

Figure 5A:
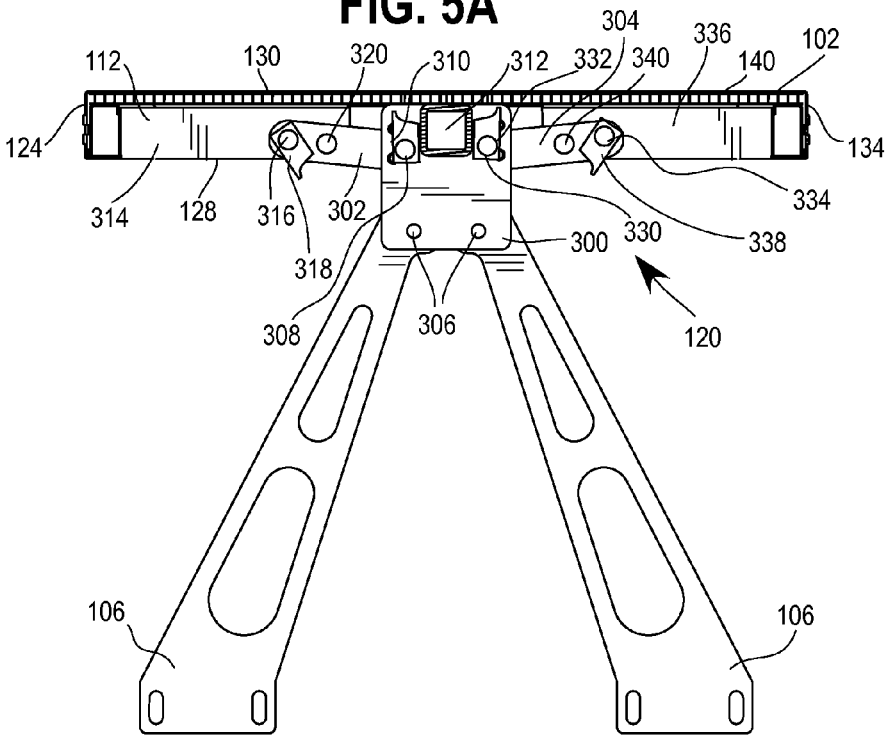
FIGS. 5A-5D are cross-sectional views taken along the line 5-5 of FIG. 3 and illustrate a deforming mechanism of the workstation table of FIG. 1.
Figure 5B:
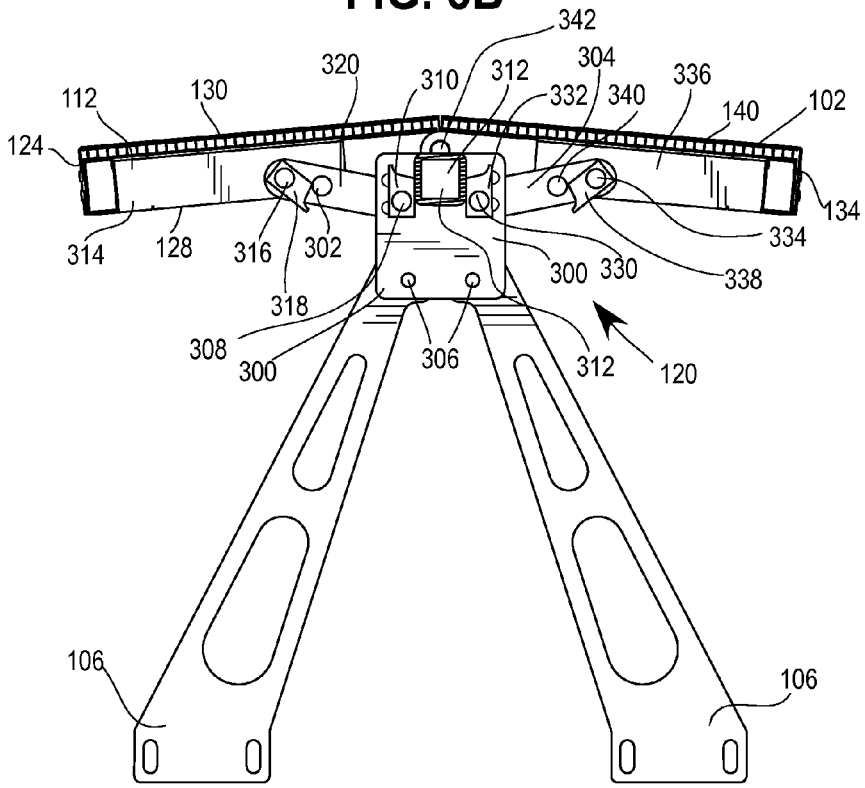
Figure 5C:
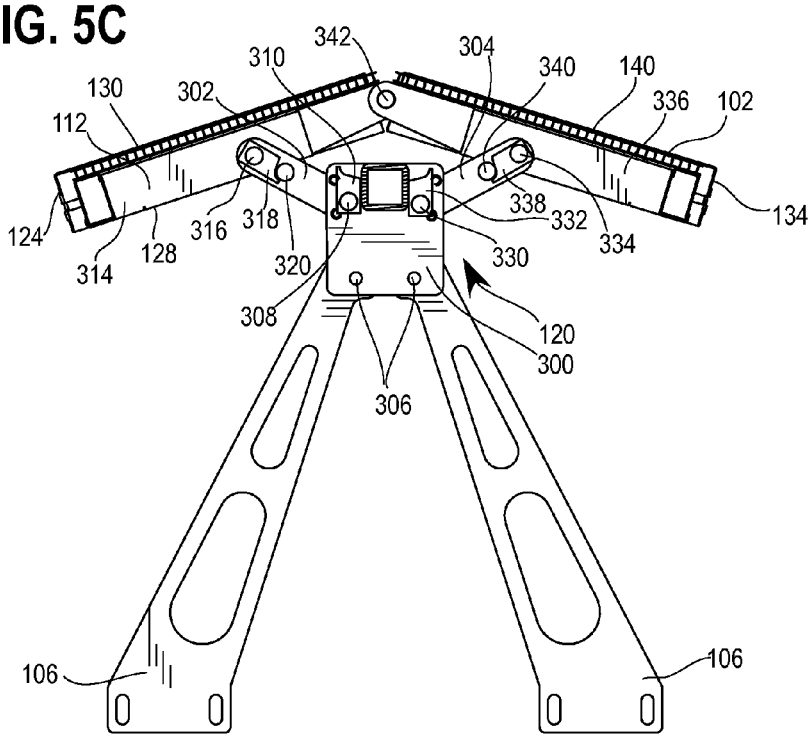
Figure 5D:
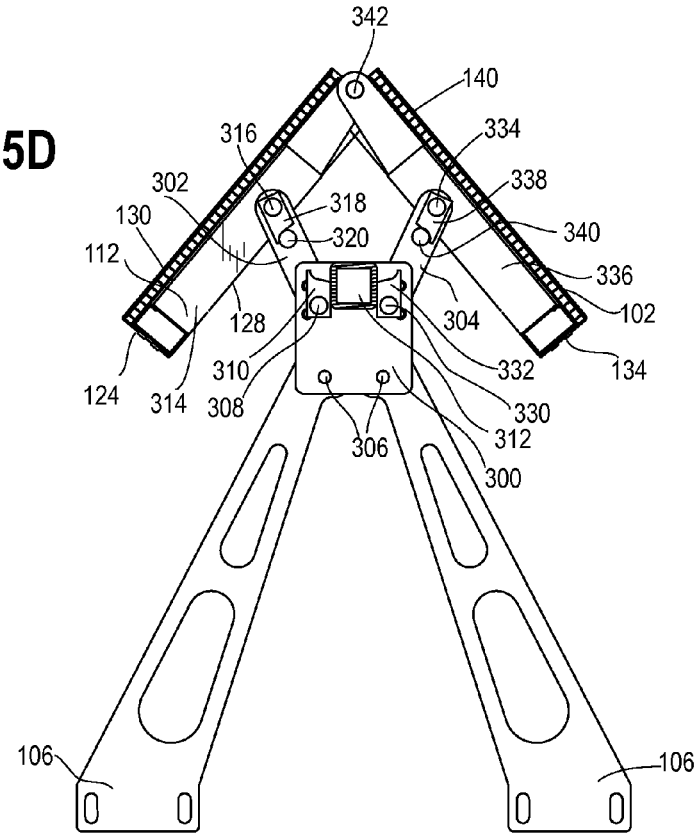
Figure 6A:
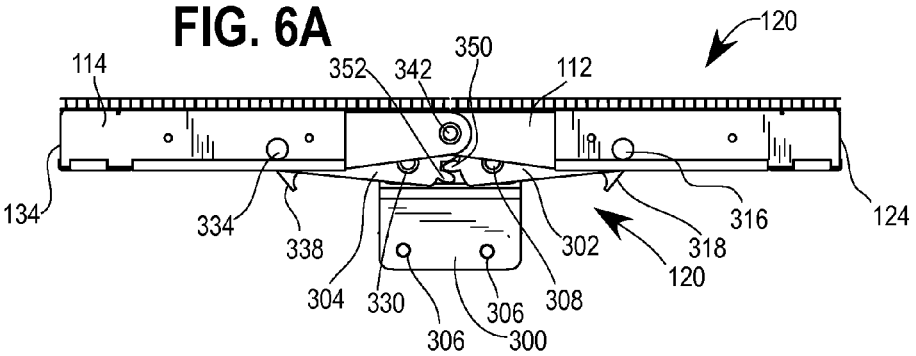
FIGS. 6A-6D are side views taken along the line 6-6 of FIG. 3 and further illustrate the deforming mechanism of the workstation table of FIG. 1.
Figure 6B:
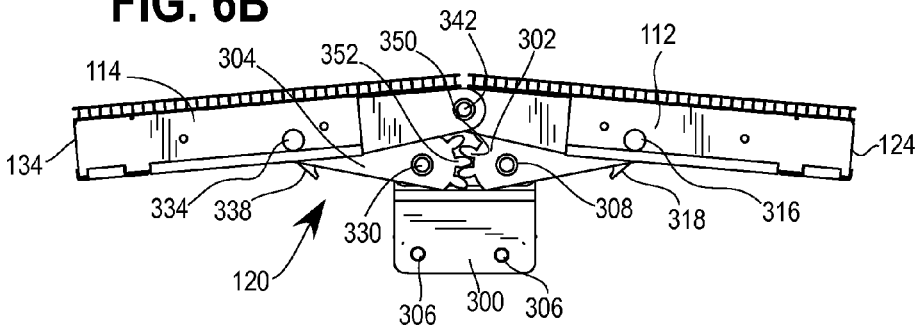

Referring to FIGS. 5A-5D and FIGS. 6A-6D, the deforming mechanism 120 may comprise a plate 300, a first arm 302, and a second arm 304. The plate 300 may be secured to the rear support 106 by one or more bolts 306. Other forms of mechanical fastening apparent to those who have skill in the art may be used instead of the bolts 306 to secure the plate 300 with the rear support 106. A first end of the first arm 302 may be pivotally secured to the plate 300 by a deformable member (e.g., a torsion bar, torsion spring, torsion pin, and the like) 308. A cam 310 may be fixedly secured to the torsion bar 308 such that the cam 310 rotates in synchrony with the torsion bar 308. A stop 312 may be fixedly secured to the plate 300 and positioned so that the cam 310 engages the stop 312 after a predetermined amount of rotation of the cam 310, and therefore, the torsion bar 308 (as shown in FIGS. 5B and 6B). As the cam 310 and the torsion bar 308 rotate, the first arm 302 moves in synchrony with such rotation.

Figure 6C:
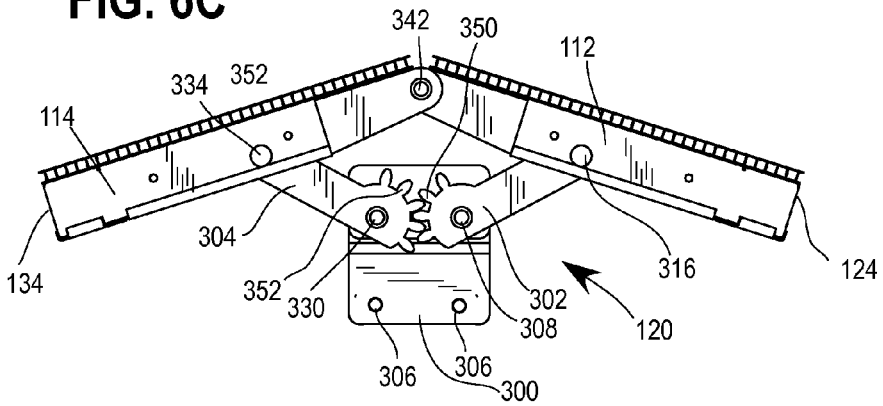

A second end of the first arm 302 opposite the first end may be pivotally secured to the rear edge 128 of the first panel 112 by a deformable member (e.g., a torsion bar or pin) 316. A cam 318 may be fixedly secured to the torsion bar 316 such that the cam 318 rotates in synchrony with the torsion bar 316. A stop 320 may be secured to the first arm 302 and positioned to engage with the cam 318 after the cam 318 has rotated a predetermined amount (as shown in FIGS. 5C and 6C). The first arm 302 also moves in synchrony with the rotation of the cam 318 and torsion bar 316. Further, the movement of the first arm 302 causes movement of the first panel 112 coupled thereto.

A deformable member (e.g., a torsion bar or pin) 330 may pivotally secure a first end of the second arm 304 to the plate 300. A cam 332 may be fixedly secured to the torsion bar 330 so that the cam 332 rotates in synchrony with the torsion bar 330. The position and size of the stop 312 may be selected so that such stop also engages the cam 332 after a predetermined amount of rotation of the cam 332 (as shown in FIGS. 5B and 6B). For example, in one embodiment, the stop 312 may be positioned such that the center of the stop 312 is equidistant from the axes of rotation of the torsion bars 308 and 330.

A deformable member (e.g., a torsion bar, spring or pin) 334 may pivotally secure a second end of the second arm 304 to an inside surface 336 of the rear edge 138 of the second panel 114. A cam 338 may be fixedly secured to the torsion bar 334 so that such cam 338 rotates in synchrony with the torsion bar 334. A stop 340 may be fixed to the second arm 304 and positioned so that the cam 338 engages the stop 340 after a predetermined amount of rotation of the cam 338 (as shown in FIGS. 5C and 6C). The second arm 304 moves in synchrony with the rotation of the cams 332 and 338, and the rotation of torsion bars 330 and 334, respectively, coupled to these cams.

If the force continues to be applied to the outside edge 124 or 134 after one or both of the cams 310 and 332 have engaged the stop 312, the torsion bars 308 and 330 secured to the cams 310 and 332, respectively, may deform and continue to rotate. Similarly, if force continues to be applied to the outside edge 124 or 134 after one or both of the cams 318 and 338 have engaged the stops 320 and 340, respectively, the torsion bars 316 and 334 secured to the cams 318 and 338, respectively, may also deform and continue to rotate. Such deformation of the torsion bars 308, 316, 330, and 334 may cause the arms 302 and 304 to move in synchrony with such deformation, and thereby cause the table 100 to continue to deform as shown in FIGS. 5A-5D even after the cams 310, 318, 332, and 338 have stopped rotating. Further, such deformation of the torsion bars 308, 316, 330, and 334 absorbs additional energy from the impact of the passenger with the outside edge 124 or 134 after the cams 310, 318, 332, and 338 have stopped rotating. These torsion bars 308, 316, 330, and 334 continue to rotate until the passenger has decelerated sufficiently so that the force applied by the passenger to the outside edge 124 or 134 is insufficient to further deform the torsion bars 308, 315, 330, and/or 334, or the table 100 has reached a predetermined maximum deformation.

In some embodiments, all of the torsion bars 308, 316, 330, and/or 334 may rotate concurrently, and may also begin to deform concurrently. In some cases the torsion bars 308 and 330 may begin to deform (because the cams 310 and 332 engage the stop 312) before the torsion bars 316 and 334 begin to deform. In some embodiments, the torsion bars 316 and 334 may begin to deform (because the cams 318 and 338 engage the stops 320 and 340, respectively) before the torsion bars 308 and 330 begin to deform. It should be apparent to one who has skill in the art that adjusting the amount of rotation the cams 310, 318, 332, and 338 may undertake before engaging with the stop associated with such cams may select when a particular torsion bar 308, 316, 330, or 334 begins to deform relative to the other torsion bars 308, 316, 330, and 334.

The deformable members 308, 316, 330, and 334 may be torsion bars or pins. Other types of deformable members may be selectively employed.

Figure 10A:
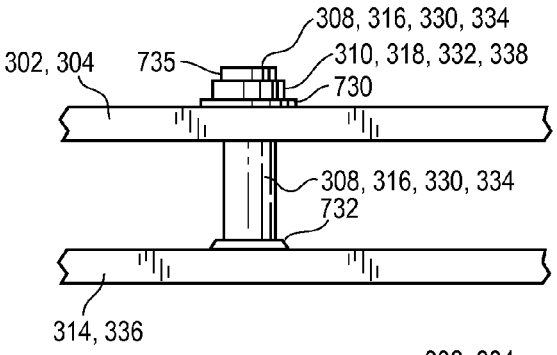
FIGS. 10A-10C are partial planar views of deformable members of the workstation table of FIG. 1.

For example, referring to FIG. 10A, in one embodiment, the deformable member 308 may be a cylindrical post or a rectangular prism that includes an outer portion 735 that is secured to the cam 310. The deformable member is passed through the arm 302, and secured to the edge 314 of the workstation table 100. In some embodiments, a welding joint 730 may affix the cam 310 to the arm 302, and a welding joint 732 may affix the deformable member 308 to the edge 314. When force is applied to the outside edge 124 or 134, the cam 310 and the deformable member 308 begin to rotate about an axis of the deformable member 308. Such rotation causes the arm 302 to which the cam 310 is secured, and the first panel 112 of the workstation table 100, to also rotate or move in synchrony with the cam 310 of the deformable member 308. After, the cam 310 engages the stop 312, if additional force is applied to the edge 124 or 134, such force causes the deformable member 308 to deform and continue to rotate, and therefore cause further rotation of the arm 302 and the first panel 112 of the table 100 in synchrony with such deformation. In one embodiment, the deformable member 316 may be affixed to the outer edge 314 and the cam 318, and arm 302 may be disposed between the cam 318 and the outer edge 314. Similarly, the deformable member 334 may be affixed to the outer edge 336 and the cam 338, and the arm 304 may be disposed between the cam 338 and the outer edge 336. In some cases, the deformable member 308 may be affixed to the cam 310 and the arm 302, and the deformable member 330 may be affixed to the cam 332 and the arm 304.

Figure 10B:
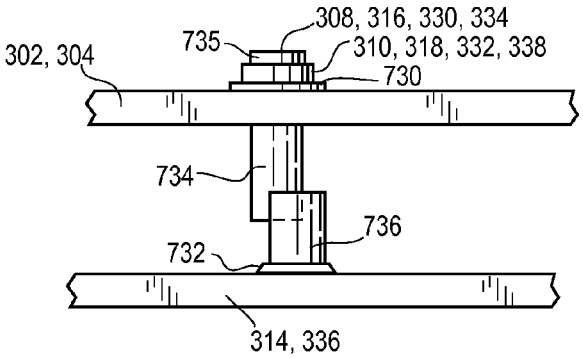

Referring to FIG. 10B, in some embodiments, the deformable member 308 may include a first plate or beam 734 secured to the outer portion 735. The outer portion 735 may secured to the cam 310, and the welding joint 730 secures the cam 310 to the arm 302. The deformable member 308 also includes a second plate or beam 736 secured to and cantilevered from the arm 314. The first plate 734 is disposed relative to the second plate 736 such that the plate 734 contacts the second plate 736 when the cam 310 engages the stop 312. When force is applied to the outside edge 124, the cam 310 and plate 734 rotate until the cam 310 engages the stop 312. Thereafter, if additional force is applied, the plates 734 and 736 continue to rotate and engage with one another. Further rotation of the plates 734 and 736 while being engaged may cause deformation of these plates. Such continued rotation and deformation may allow further movement of the arm 302 and the first panel 112 of the table 100 in synchrony with the rotation and deformation of the plates 734 and 736. In some embodiments of the arrangement shown in FIG. 10B, one or more of cams 310, 318, 332, and 338 may be omitted because the first plate 734 effectively provides the function of such cams to allow rotation of the arms 302 and 304 for a period of time without deformation of the second plate 736.

Figure 10C:
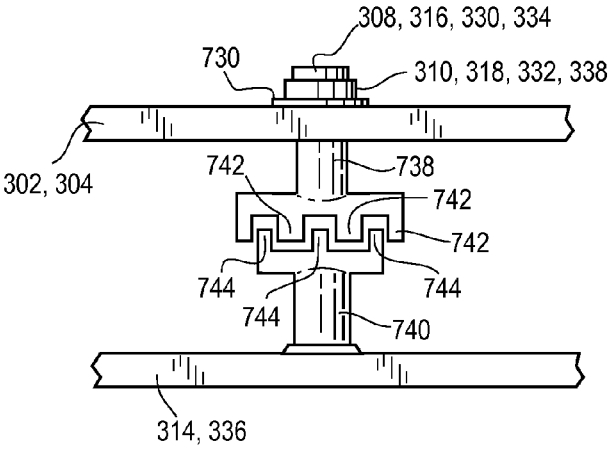

Referring to FIG. 10C, in still another embodiment, the deformable member may include a first shaft 738 secured to the cam 310, and a second shaft 740 secured to the edge 314. The first shaft 738 terminates in a first plurality of gear teeth 742 and the second shaft 740 terminates in second plurality of gear teeth 744. The first plurality of gear teeth 742 and the second plurality of gear teeth 744 are meshed with one another. When force is applied to the outside edge 124, the first shaft 738 and the second shaft 740 move in synchrony with the cam 310 and one another. Additional force causes the gear teeth 742 and 744 to move against each other such that such gear teeth become deformed or may even become separated from the first and second shafts 738 and 740. Such continued rotation of the shafts 738 and 740, and deformation of the gear teeth 742 and 744 may allow further movement of the anti 302 and the first panel 112 of the table 100 in synchrony with such rotation and deformation. As noted above with respect to FIG. 10B, the cams 310, 318, 332, and 338 may be omitted from this embodiment also because the teeth 742 effectively provide the functionality of such cams.

In the foregoing, although reference is made only to the operation of the deformable member 308 with respect to FIGS. 10A-10C, it should be apparent that any of the other deformable members 316, 330, and 334 of the workstation table 100 may be implemented as described above.

In some embodiments, a screw or pivot pin 342 may pivotally couple the first panel 112 and the second panel 114 of the workstation table 100 to one another.

When sufficient force is applied to either of the outside edges 124 or 134 of the workstation table 100, the first arm 302 and the second arm 304 rotate about the torsion bars 308 and 330, respectively, until the cams 310 and 332, respectively, engage the stop 312. Such rotation causes the first panel 112 and the second panel 114 to rotate about the pivot pin 342. In some embodiments, the first arm 302 and the second arm 304 begin to rotate about the torsion bars 308 and 330 when a predetermined force is applied to either of the outside edges 124 or 134. In some embodiments, such predetermined force may be approximately 700 pounds.

When the cams 310 and 322 engage the stop 312, as shown in FIGS. 5B and 6B, further rotation of the first arm 302 and the second arm 304 about the torsion bars 308 and 330, respectively, is prevented. If additional force is applied after engagement of the cams 310 and 322 with the stop 312, the first panel 112 of the tabletop 102 rotates relative to the first arm 302 about the torsion bar 316. Concurrently, because the pivot pin 342 couples the first panel 112 and the second panel 114, the second panel 114 of the tabletop 102 rotates relative to the second arm 304 about the torsion bar 334. The coupling of the first panel 112 and the second panel 114 by the pivot pin 342 causes both the first panel 112 and the second panel 114 to rotate in this manner when a force is applied to either of the outside edges 124 or 134. Such rotation of the first panel 112 and the second panel 114 continues until the cams 318 and 338 engage the stops 320 and 340, respectively, as shown in FIGS. 5C and 6C.

Figure 6D:
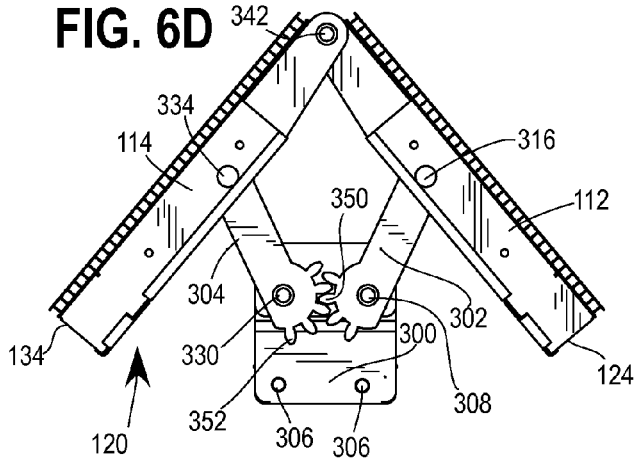

If still additional force is applied, the first panel 112 and the second panel 114 continue to rotate about the pivot pin 342, as shown in FIGS. 5D and 6D. Such rotation may continue until maximum deformation of the table 100 is achieved. In some embodiments, such maximum deformation is achieved when the first panel 112 and the second panel 114 strike one another or the supports 106 and 108 sufficiently to stop the rotation. In some embodiments, the first panel 112 and second panel 114 are made of a material that deforms, partially or completely crushes, or breaks when the front edges 126 and 136, or the rear edges 128 and 138, strike one another. Such deformation or crushing may absorb additional force applied to the outside edges 124 or 134.

Figure 11:
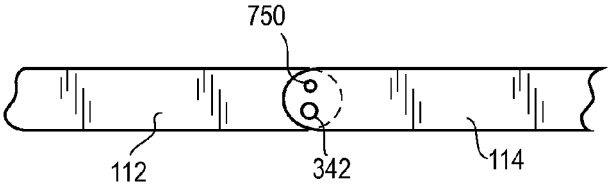
FIG. 11 is a partial planar view of the workstation table of FIG. 1 to illustrate coupling of portions of the workstation table.

Referring to FIG. 11, in some embodiments, a shear pin 750 may also couple the first panel 112 and the second panel 114. The shear pin 750 may prevent the first panel 112 and the second panel 114 from rotating about the pivot pin 342 until a force is applied to the outside edge 124 or 134 that is sufficient to deform or rupture the shear pin 750.

In other embodiments, the front edges 126 and 136 may be chamfered so that the one edge, for example the edge 126, nests inside the other, for example the edge 136, when the workstation table is in a deformed configuration (as shown in FIGS. 5D and 6D). The rear edges 128 and 138 may be similarly chamfered so that one edge, for example the edge 128, nests inside the other edge, for example the edge 138.

In some embodiments, the length of the workstation table 100 between the supports 106 and 108 may span a distance that allows two or more individuals to be seated along each of the outside edges 124 and 134 of the workstation table 100. In such embodiments, the workstation table 100 may absorb or resist at least approximately 4000 pounds of force applied to the outside edge 124 or 134 as the workstation table 100 deforms from the initial undeformed configuration shown in FIGS. 5A and 6A to the deformed configuration shown in FIGS. 5D and 6D.

In other embodiments, the length of the workstation table 100 may span a smaller distance that allows one individual to be seated along each of the outside edge 124 or 134 of the workstation table 100. In such embodiments, the workstation table 100 may resist at least 2000 pounds of force applied to the outside edge 124 or 134 as the workstation table is deformed from the undeformed configuration shown in FIGS. 5A and 6A to the deformed configuration shown in FIGS. 5D and 6D.

In an accident, a passenger impacting an exemplary embodiment of the workstation table 100 may experience loads from 0 to 2100 pounds force as the workstation table 100 deforms from an undeformed configuration (FIG. 5A) to the deformed configuration (FIG. 5D).

In some embodiments, the cams 310 and 332, and the stop 312 are disposed so that the torsion bars 308 and 330 rotate between approximately 3.5 degrees and 6.5 degrees from horizontal, and in some cases approximately 5 degrees, before the cams 310 and 312 engage the stop 312 (shown in FIGS. 5B and 6B). In such embodiments, the first panel 112 and the second panel 114 of the tabletop also rotate between approximately 3.5 degrees and 6.5 degrees from horizontal (i.e., the undeformed configuration). In other embodiments, the positions of the cams 310 and 332, and the stop 312 may selected such that the cams 310 and 332 engage the stop 312, after the torsion bars 310 and 330, respectively, have rotated approximately 1 degree. In still other embodiments, the positions of such cams 310 and 332, and the stop 312 may be selected to allow the torsion bars 310 and 330 to rotate between approximately 23.5 and approximately 26 degrees before the cams 310 and 332 engage the stop 330. The particular rotation may be selected based on the environment in which the workstation table 100 is to be disposed and the forces such workstation table 100 is expected to encounter.

In some embodiments, the position of the cam 316 and the stop 320 on the arm 302 may be selected so that the cam 316 engages the stop 320 after the arm 302 has rotated between approximately 26.5 degrees and 29.5 degrees from horizontal. Similarly, the position of the cam 338 and the stop 340 on the arm 304 may be selected so that the cam 338 engages the stop 340 when the arm 304 has rotated approximately 26.5 degrees and 29.5 degrees from horizontal.

Referring to FIGS. 6A-6D, in some embodiments, a portion of the first end of the first arm 302 may be configured with gear teeth 350 and a portion of the first end of the second arm 304 may also be configured with gear teeth 352. The first and second arms 302 and 304 may be disposed on the plate 300 so that the gear teeth 350 mesh with the gear teeth 352. Such meshing of the gear teeth 350 and 352 facilitate synchronization of movement of the first arm 302 with movement of the second arm 304, and hence, cause the first panel 112 of the workstation table 100 to move in synchrony with the second panel 114.

The deforming mechanism 118 may be substantially identical to the deforming mechanism 120 described above.

In one example embodiment of the workstation table 100, when the workstation table is in the undeformed configuration, the horizontal distance between the front edge 126 and the rear edge 128 may be approximately 44 inches. The horizontal distance between the outside edge 124 and the outside edge 134 may be approximately 28.125 inches. The horizontal distance between the center of the pivot pin 342 about which the first panel 112 and the second panel 114 pivot and the center of the torsion bar 316 about which the arm 302 rotates may be approximately 6.125 inches. A horizontal distance between the pivot pin 342 and the center of the torsion bar 308 about which the arm 302 also rotates may be approximately 1.5 inches. The vertical distance between the center of the pivot pin 342 and the center of the torsion bar 316 may be approximately 0.56 inches. The vertical distance between the center of the pivot pin 342 and the center of the torsion bar 316 may be approximately 1.03 inches. The horizontal and vertical distances between the center of the pivot pin 342 and the center of the torsion bar 330 may be identical to the horizontal and vertical distances between such screw and the center of the torsion bar 308. Similarly, the horizontal and vertical distances between the center of the pivot pin 342 and the center of the torsion bar 338 may be identical to the horizontal and vertical distances between the center of such screw and the torsion bar 316.

Once the workstation table 100 has been deformed to any degree, friction between the components thereof continues to hold the workstation table 100 in such deformed configuration. However, such friction may be overcome by applying a force on the tabletop 102, which causes the workstation 100 to return to the undeformed configuration. If the workstation table 100 is disposed adjacent a sidewall of a transit car that includes a window, the return of the workstation table 100 into such undeformed configuration may provide sufficient clearance for emergency personnel to enter the transit car through such window. In one example embodiment, the each torsion bar 308, 316, 330, and 338 is manufactured from a plastically deforming material. Once torque has been applied to the torsion bar 308, 316, 330, or 338 to rotate such torsion bar, for example, when the workstation table 100 deforms, such torsion bar remains rotated (or torqued) even if the workstation table 100 is returned to the undeformed configuration.

Figure 7A:
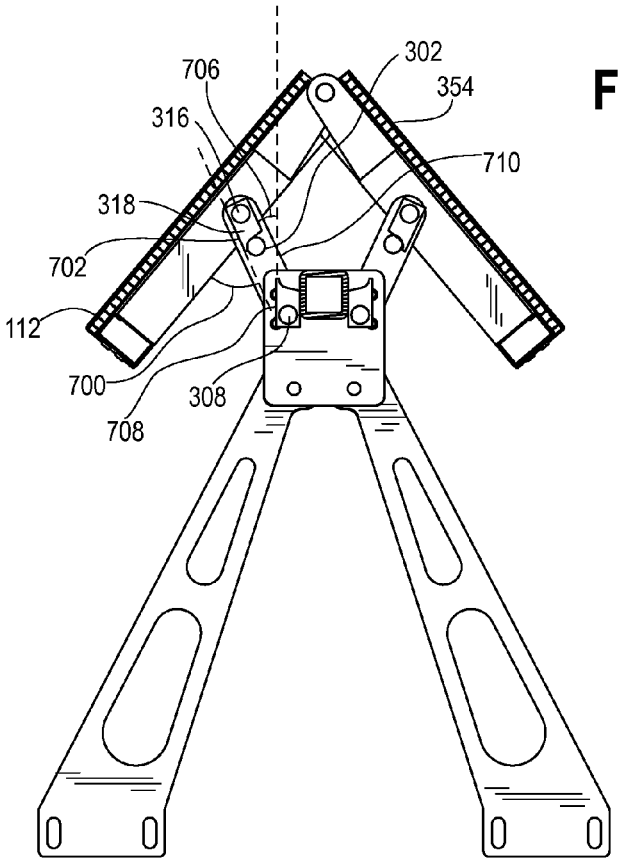
FIGS. 7A-7D are cross-sectional views taken along the line 5-5 of FIG. 3 to illustrate returning the workstation table of FIG. 1 from a deformed configuration to an undeformed configuration.
Figure 7B:
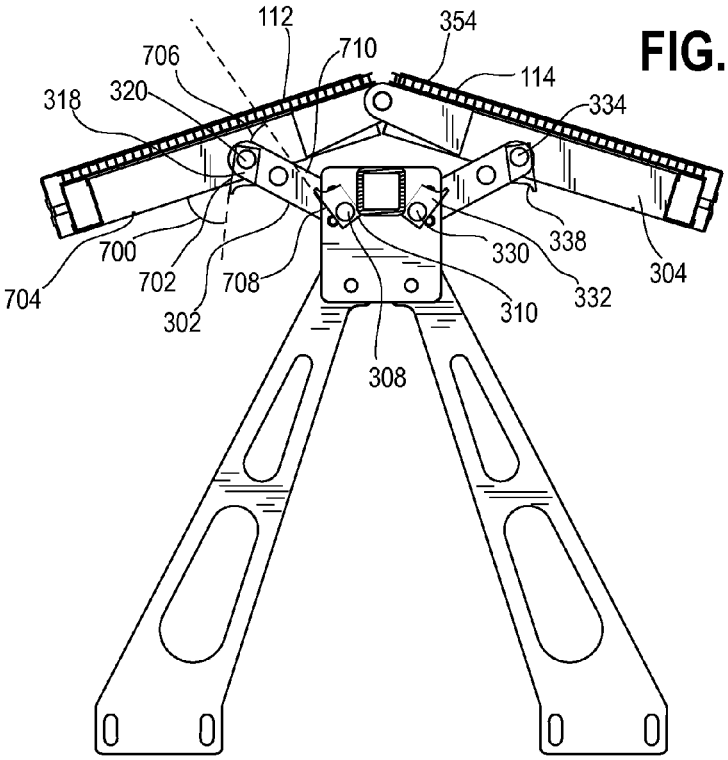
Figure 7C:
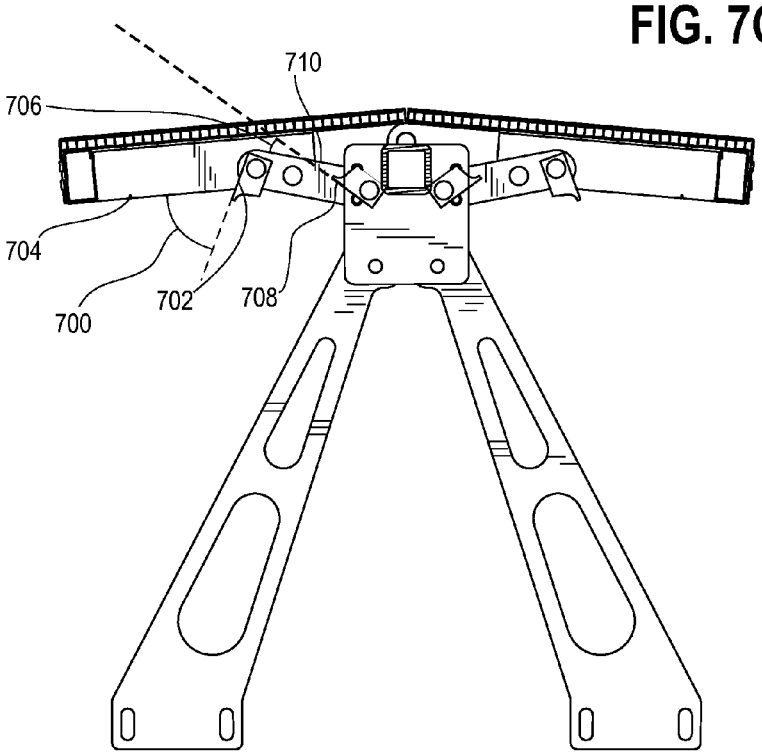
Figure 7D:
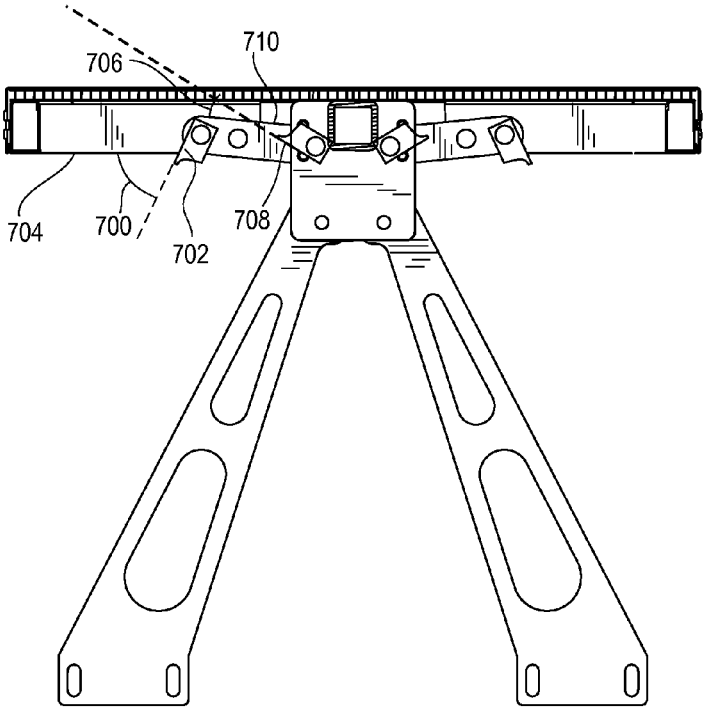

FIGS. 7A-7D show the workstation table 100 starting in a deformed configuration (FIG. 7A), before progressively returning to an undeformed position (FIGS. 7B and 7C), until the workstation table returns to the completely undeformed configuration (FIG. 7D). Because the cam 318 is fixedly attached to the torsion bar 316, neither the torsion bar 316 nor the cam 318 rotates as the workstation table 100 is returned to the undeformed configuration (FIG. 7D) from the deformed configuration (FIG. 7A). Similarly, none of the other torsion bars 316, 330, and 334 and respective cams 318, 330, and 338 fixedly secured thereto rotate as the workstation table 100 returned to the undeformed configuration (FIG. 7D). As a result, an angle 700 spanned by an edge 702 of the cam 318 and an edge 704 of the first panel 112 to which the torsion bar 316 is secured remains substantially constant as the workstation tables moves from the deformed configuration (FIG. 7A) to the undeformed configuration (FIG. 7D). Similarly, an angle 706 spanned by an edge 708 of the cam 310 and an edge 710 of the arm 302 remains substantially constant as the table is returned from the deformed configuration (FIG. 7A) to the undeformed configuration (FIG. 7D). Similarly, angles between the cams 330 and 338 and the edges of the second panel 114 and the arm 304 remain substantially constant as the table moves through the configurations illustrated in FIGS. 7A-7D.

Figure 8:
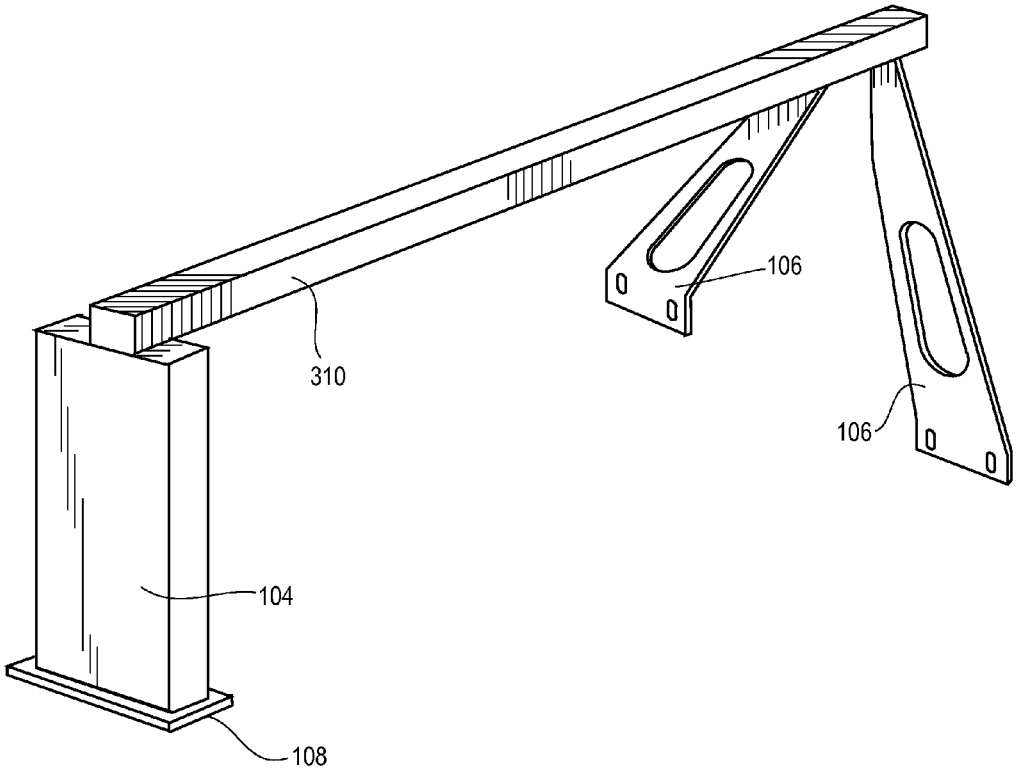
FIG. 8 is an isometric view of the workstation table of FIG. 1 without the tabletop thereof.

Referring to FIG. 8, the stop 310 of FIGS. 5A-5D may be a structural component that extends the length of the workstation table and to which the table supports 104 and 106 may be attached. In some embodiments, the deforming mechanisms 118 and 120 may also be attached to such structural component.

Figure 9:
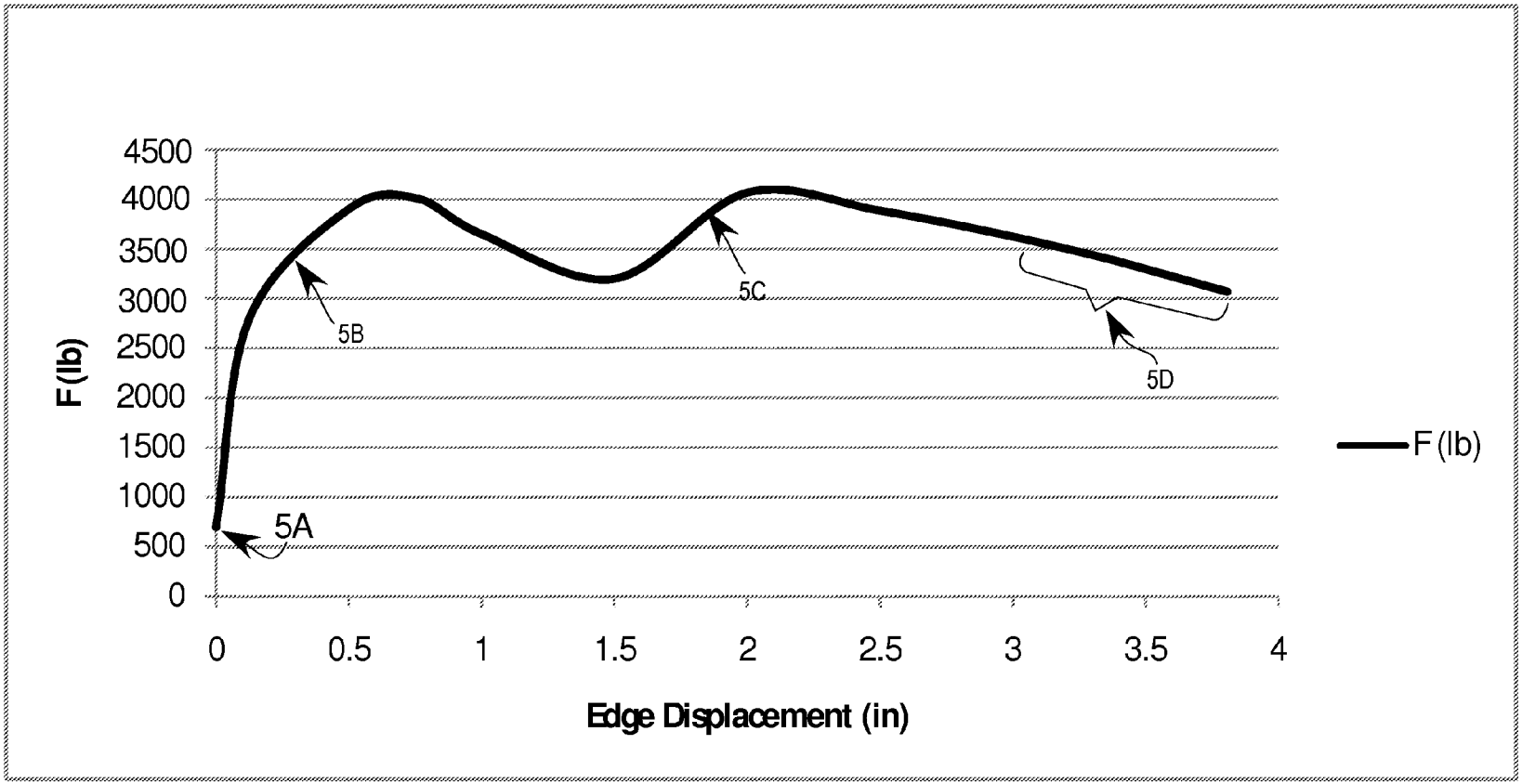
FIG. 9 is a graph that shows force versus edge displacement in an exemplary workstation table of FIG. 1.

FIG. 9 shows a graph of the horizontal displacement of the outside edge 124 or 134 versus force absorbed by an exemplary embodiment of the workstation table 100 at such displacement, as the table deforms from the configuration shown in FIG. 5A through the configuration shown in FIG. 5B. The labels 5A-5D shown in such graph correspond to the configurations of the table shown in respective FIGS. 5A-5D. The label associated with 5D in the graph corresponds to a situation when all of the cams have been engaged, and the table may still continue to compress until the edges crush or nest as described above.

The components of the workstation table 100 described above may be manufactured from steel, stainless steel, aluminum, plastics, fiber reinforced plastics, composites, high pressure laminates, and the like. The torsion bars described above may be manufactured from steel, stainless steel, or other materials that will be apparent to those having skill in the art.

The energy absorption characteristics of the workstation table 100 may be customized by modifying the lengths of one or both of the arms 302 and 304; modifying how much one or both of the cams 318 and 338 may rotate before engaging the stops 320 and 340, respectively; modifying how much one or both of the cams 310 and 332 may rotate before engaging the stop 312; modifying the materials that comprise the torsion bars 308, 316, 330, and 334; modifying the angle spanned by the arms 302 and 304 when the table 100 is in the initial undeformed configuration; modifying the distance between the pivot pin 342 and where the arms 302 and 304 are secured to the first panel 112 and the second panel 114, respectively; and/or modifying the diameters of the torsion bars 308, 316, 330, and 334. The energy absorption characteristics of the workstation table 100 may be further customized by trimming the outside edges 124 and 134 with an energy absorbent or cushioned material such as a metal honeycomb, or a crushable material such as a foam, for example, Styrofoam.

For example, increasing the length of the arms 302 and 304 may result in a corresponding increase in the amount of energy the workstation table 100 may absorb. The length of the arms 302 and 304 may also so be selected in accordance with a desired height of the workstation table 100 when such table is in the fully deformed configuration.

Similarly, increasing how much the cam 310 may rotate before engaging the stop 312 may determine how much the workstation table 100 deforms in response different amounts of forces applied thereto, because such rotation may affect the amount of energy that is absorbed by the deformation of the torsion bar 308 relative to the amount of energy that is absorbed by the deformation of the torsion bar 316.

As apparent to one who has skill in the art, amount of energy absorbed by the workstation table 100 due to the deformation of the torsion bars 308, 316, 330, and 334 depends on the amount of torque (toque to yield) required to achieve a plastic deformation, yielding, or a permanent change in the shape of the torsion bars 308, 316, 330, and 334. The torque to yield (T) of the torsion bar 308, 316, 330, or 334 depends on the diameter (D) of the torsion bar 308, 316, 330, or 334, and the torsional yield strength (c) of the material that comprises such torsion bar 308, 316, 330, or 334. The value of the torque to yield (T) may be calculated from the torsional yield strength (T) and the diameter as follows:

$$T=(\tau^*\pi D^3)/16$$

For example, if the 1018 steel has a torsional yield strength of 30,609 psi. Accordingly, the following table shows torque to yield of a torsion bar made from 1018 steel and having various diameters:

| Diameter (in) | Torque to Yield (in-lb) |
|---|---|
| 0.063 | 2 |
| 0.125 | 12 |
| 0.188 | 40 |
| 0.25 | 94 |
| 0.375 | 317 |
| 0.5 | 751 |
| 0.75 | 2535 |
| 1 | 6010 |

In an exemplary workstation table 100, the outside edges 124 and 134 are between approximately 15 and approximately 36 inches long; front edges 126 and 136 and rear edges 128 and 138 that are between approximately 20 and approximately 56 inches long. Each arm 314 and 336 of such table is between approximately 7.5 and approximately 18 inches long. The distance between the torsion bars 308 and 316, and between the torsion bars 330 and 334, may be between approximately 3 and 10 inches. The torsion bars 308, 316, 330, and 334 may be cylindrical and each may have a diameter of less than approximately one inch, and in some cases between approximately 0.2 inches and approximately 0.4 inches. In one embodiment, the torsion bars 308 and 330 have a diameter of approximately 0.25 inches, and the torsion bars 316 and 338 have a diameter of approximately 0.3125 inches. In some embodiments, if the torsion bars are manufactured from 1018 steel, the workstation table will absorb resist with between 10 pounds and 1200 pounds of force when the workstation table begins to deform (i.e., the torsion bars 316 and 334 begin to deform), between 100 and 4500 pounds of force when the cam 318 engages the cam 320, and between 100 and 4500 pounds of force to deform the table to fully deformed configuration.

In some embodiments the workstation table 100 may include a top layer 354 that is affixed to the first and second panels 112 and 114. Such top layer 354 may be affixed so that the top layer 354 does not separate from the first and second panels 112 and 114 when the workstation table 100 deforms. In some embodiments, the top layer 354 may crack or otherwise become damaged, but pieces of the top layer 354 do not separate from the panels 112 and 114 and create a projectile hazard. In some embodiments, the top layer 354 is manufactured from an acrylic, a metal, vinyl, melamine, and the like. The top layer 354 may be affixed to the first and second panels 112 and 114 using, for example, an adhesive. In one embodiment, the adhesive is uniformly applied between the top layer 354 and the panels 112 and 114, so that substantially of the top layer 354 is bonded to the panels 112 and 114.

Figure 12:
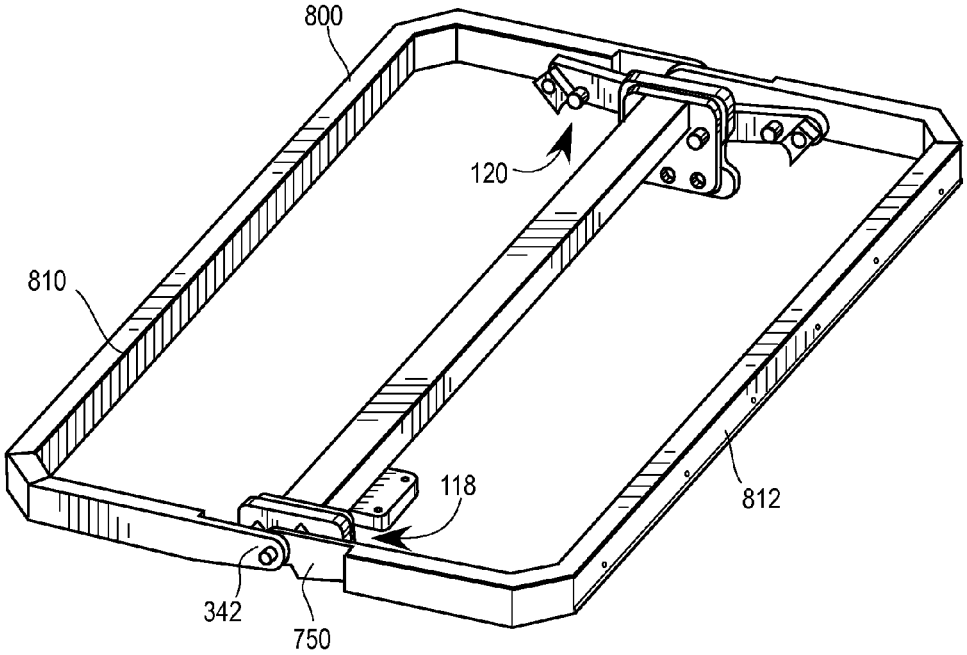
FIG. 12 is an isometric view of a frame that comprises a tabletop of the workstation table of FIG. 1.
Figure 13:
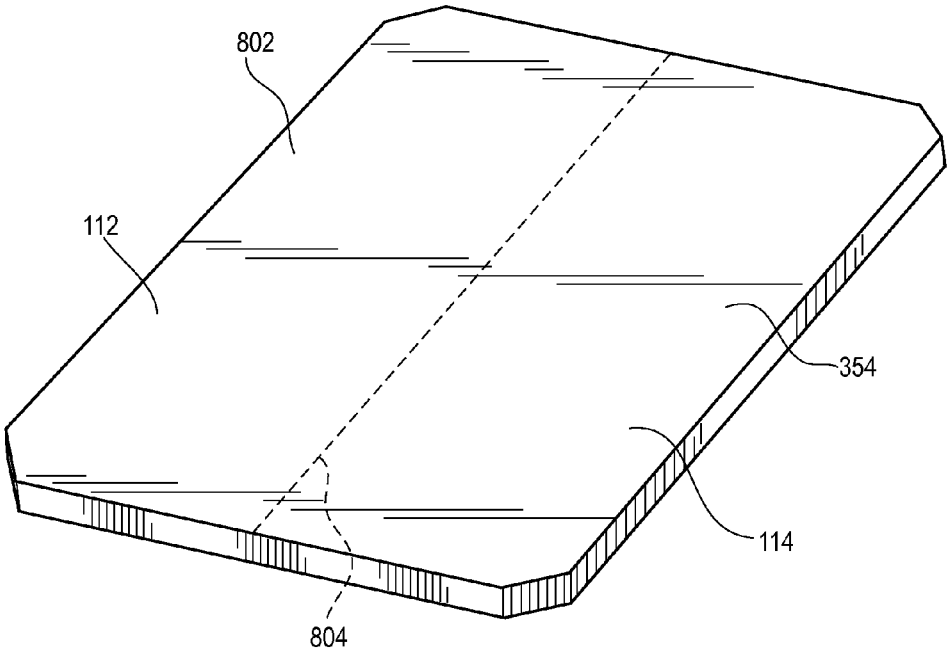
FIG. 13 is an isometric view of a top member that comprises the tabletop of the workstation table of FIG. 1.

Referring to FIGS. 12 and 13, in some embodiments, the tabletop 102 may comprise a frame 800 and a top member 802 secured to the frame 800. In some embodiments, the top member 802 may be may manufactured from a honeycomb metal, a laminate, and the like, to which the top layer 354 is affixed, for example, by an adhesive. In other embodiments, the top layer 354 may be integral with the top member 802. The top member 802 may include the first panel 112 and the second panel 114 separated by a bendable portion 804. In some embodiments, the first panel 112 and the second panel 114 are an integral unit and comprise a single sheet. In other embodiments, the first panel 112 and the second panel 114 comprise separate sheets of material. In some embodiments, the bendable portion 804 couples the first panel 112 and the second panel 114. When force is applied to the workstation table 100 the first panel 112 and the second panel 114 rotate relative to the bendable portion 804.

In some embodiments, the frame 800 includes a first frame portion 810 and a second frame portion 812. The first frame portion 810 and the second frame portion 812 may be pivotally coupled to one another by the pivot pin 342, and optionally the shear pin 750. The deforming mechanisms 118 and 120 are secured the first frame portion 810 and the second frame portion 812. Specifically, the deforming members 308, 316, 330, and 334 are secured to the edges of the corresponding first frame portion 810 and the second frame portion 812 as described above.

In some embodiments, the table member 802 is secured to the frames by screws (not shown), an adhesive, welding, and the like.

An embodiment of the workstation table 100 when installed in a transit car may at least meet one or more of the following safety criteria with respect to an anthropomorphic test device that has an interaction with such table 100 during a crash test per rail standards:

Remain attached during testing;

A head injury criteria (HIC) that does not exceed 700;

A neck injury criteria (Nij) that does not exceed 1.0;

Neck axial tension of less than 938 lbf (4000 N);

Chest deceleration of less than 60 G over a 3 ms clip;

Chest compression (the distance the sternum may be pressed) of less than 2.5 inches (63 mm);

Chest viscous criterion that measures internal damage to the chest area less than 1.0 m/s;

Abdominal compression less than 2.6 inches (67 mm);

Abdominal viscous criterion less than 1.98 m/s; and

Axial femur loads less than 2250 lbf (10,000 N).

In addition, during quasi-static testing as is known to those having skill in the art, an embodiment workstation table 100 will also meet one or more of the following criteria:

Remain attached during testing;

Absorb 6,250 in-lb of energy for each passenger that may impact it; and

Force remains less than 2,250 lbf per passenger.

The above criteria refer to test measurements and computations that have been defined by industry organizations, for example, the American Public Transportation Association (APTA), or that are apparent to those having skill in the art.

The workstation table 100 and the five point deforming mechanisms 118 and 120 described above is simple and adaptable to different applications. The geometry of such deforming mechanism 118 and 120 including distances between the pivot pin 342 and the various torsion bars 308, 316, 330, and 334, and rotations undertaken by the various cams 310, 318, 332, and 338 may be modified. Such modifications may be made to achieve desired outcomes in terms of packaging such workstation table 100 and deforming mechanisms 118 and 120, and also to achieve desired outcomes in an interaction between a passenger and the workstation table 100 in the event of an accident. Such modifications to the geometry and/or torque loads of such torsion bars will be apparent to those who have skill in the art. For example, in some embodiments, some or all of the torsion bars 308, 316, 330, and 334 may be modified to be simple pins that are used as pivots, and which do not provide resistance. Such a modification may be made to reduce the load or change the forces absorbed by the workstation table at certain displacements.

INDUSTRIAL APPLICABILITY

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the disclosure (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An energy absorbing table, wherein the table deforms in response to application of a force thereto, comprising:

a support member;

a first panel;

a first arm, the first arm coupled to the support member by a first deformable member and to the first panel by a second deformable member;

a first cam and a first stop associated with the first deformable member; and wherein application of force to the first panel causes the first arm to move in synchrony with the first deformable member and the second deformable member, the first deformable member rotates with the first cam until the first cam engages the first stop, and wherein application of force to the first panel after engagement of the first cam and the first stop, causes the first deformable member permanently deform, and the first arm to move in synchrony with deformation of the first deformable member.

2. The energy absorbing table of claim 1, further comprising a second panel, a second arm coupled to the second panel, a third deformable member that couples the second panel to the support member, wherein when the force is applied to one of the first and the second panel, the second arm moves in synchrony with the third deformable member.

3. The energy absorbing table of claim 2, further comprising a second cam and a second stop associated with the third deformable member, wherein when the force is applied to one of the first panel and the second panel, the third deformable member rotates with the second cam until the second cam engages the second stop, and application of force after engagement of the second cam with the second stop causes the third deformable member to deform.

4. The energy absorbing table of claim 2, wherein the first arm comprises a first end proximate the first deformable member, and the second arm comprises a second end proximate the third deformable member, wherein the first end and the second end each comprise gear teeth, and the gear teeth at the first end mesh with the gear teeth at the second end.

5. The energy absorbing table of claim 2, wherein the first panel and the second panel are an integral unit and the first panel and the second panel move in synchrony with one another.

6. The energy absorbing table of claim 2, wherein the deformable members are one of torsion bars, torsion springs, cantilevered beams, cantilevered panels and gear teeth.

7. The energy absorbing table of claim 6, wherein the deformable members are steel bars and have a diameter of less than or equal to approximately one inch.

8. The energy absorbing table of claim 2, further comprising a shear pin, wherein the first panel and the second panel are coupled to one other by the shear pin, wherein rotation of one of the first panel and the second panel causes the shear pin to deform or rupture.

9. The energy absorbing table of claim 1, wherein the support member is secured to at least one of a sidewall and a floor of a transit car, and the support member remains secured to the at least one of the sidewall and the floor of the transit car when the first panel rotates.

10. An energy absorbing table, wherein the table deforms in response to application of energy thereto, comprising:

a support member;

a first panel;

an arm, the arm coupled to the support member by a first deformable member;

a first cam and a first stop associated with the first deformable member; and wherein when a force is applied to the first panel, the arm moves in synchrony with both the first deformable member and the first cam until the first cam engages the first stop, the arm moves in synchrony with deformation of the first deformable member after the first cam engages the first stop, and the amount of force necessary to cause permanent deformation of the deformation member and the arm to move after the first cam engages the first stop is determined by a characteristic of the first deformable member.

11. The energy absorbing table of claim 10, wherein the characteristic is a diameter of the first deformable member, and the diameter is less than approximately one inch.

12. The energy absorbing table of claim 10, wherein the characteristic is a material from which the deformable member is manufactured.

13. The energy absorbing table of claim 12, wherein the material comprises at least one of 1018 steel, stainless steel, a low carbon steel, a metal, and a metal alloy.

14. The energy absorbing table of claim 10, wherein the first deformable member is one of a torsion bar, torsion spring, cantilevered beam, a cantilevered panel, and a gear tooth.

15. The energy absorbing table of claim 10, wherein rotation of the arm causes the first panel to rotate about the first deformable member.

16. The energy absorbing table of claim 10, wherein the arm is coupled to the first panel by a second deformable member, and the first panel rotates in synchrony with deformation of the second deformable member.

17. The energy absorbing table of claim 10, wherein the first panel includes an outside edge, wherein the outside edge moves towards the support member as the first panel rotates.

18. The energy absorbing of claim 10, including a second panel and a top layer, wherein the second panel is disposed adjacent the first panel and the top layer is affixed to at least a portion of a top of the first panel and a portion of a top of the second panel, wherein the second panel moves in synchrony with the first panel and the top layer remains secured to the first and second panels when the first and second panels move.

19. The energy absorbing table of claim 10, wherein the support member is secured to at least one of a sidewall and a floor of a transit car, and the support member remains secured to the at least one of the sidewall and the floor of the transit car when the first arm moves.

20. The energy absorbing table of claim 19, wherein the deformable table is disposed between facing seats.

21. A workstation table, comprising:

a first panel, the first panel having a first top surface and a first outer edge;

a second panel, the second panel having a second top surface and a second outer edge;

a support member;

a first deforming mechanism coupled to the first panel and the support member, and comprising a first permanently deformable member; and wherein when a force is applied to the first outer edge, the first deforming mechanism causes permanent deformation of the first permanently deformable member, and causes the first panel to move from a first configuration in which the a first top surface and the second top surface occupy substantially parallel planes to a second configuration in which the first top surface and the second top surface do not occupy substantially parallel planes.

22. The workstation table of claim 21, wherein the support member is secured to at least one of a floor or a sidewall of a transit vehicle, and the support member remains secured to the at least one of the floor or the sidewall as the first panel moves from the first configuration to the second configuration.

23. The workstation table of claim 22, wherein the force results from a body colliding with the table due to a deceleration of the transit vehicle.

24. The workstation table of claim 21, wherein when the first panel is in the second configuration the first top surface and the second top surface span an acute interior angle between approximately 35 and 43 degrees.

25. The workstation table of claim 21, further comprising a second deforming mechanism that moves the second panel in synchrony with the first panel, and wherein the first deforming mechanism comprises an arm, a first cam, and a first stop, wherein the first permanently deformable member is coupled to the arm and the support member, and when the force is applied to the first edge, the arm, the cam, and the first permanently deformable member move an axis of the first permanently deformable member until the cam engages the stop.

26. The workstation table of claim 25, wherein the cam rotates in synchrony with the first permanently deformable member.

27. The workstation table of claim 25, wherein applying additional force causes the first panel to move in synchrony with deformation of the first permanently deformable member.

28. The workstation table of claim 27, wherein the first outer edge moves closer to the second outer edge as the arm pivots.

29. The workstation table of claim 27, wherein the first and the second permanently deformable members are permanently deformed when the first panel is moved from the first configuration to the second configuration.

30. The workstation table of claim 21, wherein the first outer edge is substantially parallel to the second outer edge.

31. The workstation table of claim 21, wherein the first panel includes a first inner edge and a first front edge, and the second panel includes a second inner edge and a second front edge, wherein the first inner edge is substantially parallel to the second inner edge, and the first panel and the second panel are disposed so that the first inner edge is proximate the second inner edge.

32. The workstation table of claim 31, wherein the first panel includes a first side edge and the second panel includes a second side edge, wherein when the first panel is moved into the second configuration, a portion of the first side edge proximate the first inner edge nests inside the second side edge proximate the second inner edge.

33. The workstation table of claim 31, further comprising a pin that secures the first front edge with the second front edge, and one of the first side edge and the second side edge is chamfered.

34. The workstation table of claim 31, wherein applying a downward force on the first panel adjacent the first inner edge causes the first panel to move from the second configuration to the first configuration.

35. The workstation table of claim 21, wherein the first permanently deformable member is a torsion bar.

* * * * *